US012000408B2

(12) United States Patent
Yao et al.

(10) Patent No.: US 12,000,408 B2
(45) Date of Patent: Jun. 4, 2024

(54) FAIRING AND FAN DEVICE

(71) Applicant: Sungrow Power Supply Co., Ltd., Hefei (CN)

(72) Inventors: Qi Yao, Hefei (CN); Jie Zhou, Hefei (CN); Xin Yang, Hefei (CN)

(73) Assignee: Sungrow Power Supply Co., Ltd., Hefei (CN)

( * ) Notice: Subject to any disclaimer, the term of this patent is extended or adjusted under 35 U.S.C. 154(b) by 0 days.

(21) Appl. No.: 18/170,018

(22) Filed: Feb. 16, 2023

(65) Prior Publication Data

US 2023/0279871 A1 Sep. 7, 2023

(30) Foreign Application Priority Data

Mar. 3, 2022 (CN) ..... 202220490190.X

(51) Int. Cl.
*F04D 29/54* (2006.01)
*F04D 19/00* (2006.01)
*F04D 29/52* (2006.01)

(52) U.S. Cl.
CPC ..... *F04D 29/522* (2013.01); *F04D 19/002* (2013.01); *F04D 29/541* (2013.01)

(58) Field of Classification Search
CPC .... F04D 29/522; F04D 19/002; F04D 29/541; F04D 29/542; F04D 29/667; F04D 29/703
See application file for complete search history.

(56) References Cited

U.S. PATENT DOCUMENTS 5,088,886 A * 2/1992 Hopkins ..... F04D 29/667 415/206
2005/0263199 A1* 12/2005 Meheen ..... F15D 1/0005 138/44
2015/0104294 A1* 4/2015 Hustvedt ..... F04D 29/663 415/119
2018/0156240 A1* 6/2018 Müller ..... F04D 29/4233
2018/0238352 A1* 8/2018 Guo ..... F04D 29/703
(Continued)

FOREIGN PATENT DOCUMENTS

CN 205025835 U 2/2016
DE 10 2019 119 625 A1 1/2021

OTHER PUBLICATIONS

Extended European Search Report for European Application No. 23156046.7, dated Jul. 25, 2023.

*Primary Examiner* — Aaron R Eastman
(74) *Attorney, Agent, or Firm* — Wolf, Greenfield & Sacks, P.C.

(57) ABSTRACT

A fairing and a fan device are provided according to the present disclosure. The fairing includes a fairing body which is arranged at a fan air vent, the fairing body has a fairing area, which is annular and is located at a periphery of a geometric center of the fairing body, and the fairing area is provided with a fairing through hole. In the fairing according to the present disclosure, the fairing body has the fairing area, the fairing area is provided with the fairing through hole, and the fairing body is configured to arranged at the fan air vent, so that the airflow is faired through the fairing through hole, the fairing area is annular and is located at the periphery of the geometric center of the fairing body, so that the fairing body has no fairing through hole at its geometric center.

12 Claims, 10 Drawing Sheets

(56) References Cited

U.S. PATENT DOCUMENTS

| | | | | |
|---|---|---|---|---|
| 2018/0347594 | A1* | 12/2018 | Arenella | F04D 29/703 |
| 2020/0116165 | A1* | 4/2020 | Loercher | F04D 29/542 |
| 2021/0164495 | A1* | 6/2021 | Loercher | F04D 29/541 |

* cited by examiner

FAIRING AND FAN DEVICE

FIELD

The present disclosure relates to the technical field of fan heat dissipation, and in particular to a fairing and a fan device.

BACKGROUND

A fan is widely used in a heat dissipation system. With the increase of the power of electrical equipment, the requirement for air volume increases gradually.

At present, the main way to increase the air volume is to increase the number of fans, but it causes noise problem. Therefore, how to reduce the noise of the fan is an urgent problem for those skilled in the art.

SUMMARY

In view of this, an object according to the present disclosure is to provide a fairing, so as to reduce the noise of a fan. Another object according to the present disclosure is to provide a fan device including the fairing.

In order to achieve the above objects, the following technical solution is provided according to the present disclosure:

a fairing includes a fairing body which is arranged at a fan air vent, the fairing body has a fairing area, the fairing area is annular and is located at a periphery of a geometric center of the fairing body, and the fairing area is provided with a fairing through hole.

In an embodiment, the fairing body is provided with a non-fairing area at an inner side of an inner ring of the fairing area, and the non-fairing area is provided with a material saving structure.

In an embodiment, the material saving structure is a material saving through hole or a hollow structure.

In an embodiment, the material saving structure is a material saving through hole, and a hole wall of the material saving through hole coincides with the inner ring of the fairing area.

In an embodiment, the fairing body is provided with a non-fairing area at an inner side of an inner ring of the fairing area, an inner side surface of the non-fairing area is flush with an inner side surface of the fairing body, and an outer side surface of the non-fairing area is flush with an outer side surface of the fairing body.

In an embodiment, an inner ring of the fairing area is in shape of circle, and an outer ring of the fairing area is in shape of circle or polygon.

In an embodiment, the fairing body is provided with a non-fairing area at an inner side of an inner ring of the fairing area, a projection of the non-fairing area on a projection plane completely falls on an end surface of a fan rotation shaft, and the projection plane is coplanar with the end surface of the fan rotation shaft.

In an embodiment, the inner ring of the fairing area is in shape of circle, and $0<r\leq r_0$; where r is a radius of the inner ring of the fairing area, and $r_0$ is a radius of the fan rotation shaft.

In an embodiment, a projection of the fairing area on a projection plane and a projection of a fan duct on the projection plane have an overlapping portion, and the projection plane is perpendicular to an axis of the fan duct;

and/or, an outer ring of the fairing area is not extended beyond a fan housing of a fan.

In an embodiment, if an outer ring of the fairing area is in a shape of circle, $R\geq R_0$;

and if the outer ring of the fairing area is in shape of polygon, $L\geq R_0$;

where R is a radius of the outer ring of the fairing area, $R_0$ is an inner diameter of a fan duct, and L is a minimum distance between a side of the polygon and a geometric center of the polygon.

In an embodiment, the fairing through hole is in shape of circle or regular polygon.

In an embodiment, if the fairing through hole is in shape of circle, 1 mm$\leq R_1<$20 mm, 0.01 mm$\leq h\leq$0.5 mm, and 2 mm$\leq D\leq$50 mm;

or if the fairing through hole is in shape of regular polygon, 1 mm$\leq L_1\leq$20 mm, 0.01 mm$\leq h\leq$0.5 mm, and 2 mm$\leq D\leq$50 mm;

where $R_1$ is a radius of the fairing through hole, $L_1$ is a side length of the regular polygon, h is a minimum distance between two adjacent fairing through holes, and D is a thickness of the fairing area.

In an embodiment, an edge of the fairing body has mounting holes for being arranged on a fan;

and/or, the fairing body is in shape of quadrate;

and/or, the edge of the fairing body is flush with an edge of a fan housing.

In an embodiment, the fan air vent is an air inlet and/or an air outlet.

In the fairing according to the present disclosure, the fairing body has the fairing area, the fairing area is provided with the fairing through hole, and the fairing body is arranged at the fan air vent, so that the airflow is faired through the fairing through hole, which reduces the turbulence at the fan air vent, thereby reducing the noise of the fan; in addition, the fairing area is annular and is located at the periphery of the geometric center of the fairing body, so that the fairing body has no fairing through hole at its geometric center, which not only ensures the noise reduction effect, but also facilitates of processing and reduces the cost.

Based on the above fairing, a fan device is further provided according to the present disclosure, which includes a fan and the fairing according to any one of the above.

In an embodiment, the fan air vents are an air inlet and an air outlet, and the fairing body arranged at the air inlet is the same as or different from the fairing body arranged at the air outlet.

In an embodiment, the fairing body is detachably fixed to a fan housing of the fan;

and/or, the fan is an axial-flow fan.

BRIEF DESCRIPTION OF THE DRAWINGS

For more clearly illustrating embodiments of the present disclosure or the technical solutions in the conventional technology, drawings referred to for describing the embodiments or the conventional technology will be briefly described hereinafter. Apparently, the drawings in the following description are only examples of the present disclosure, and for the person skilled in the art, other drawings may be obtained based on the drawings provided without any creative efforts.

DETAILED DESCRIPTION OF THE EMBODIMENTS

The technical solutions in the embodiments of the present disclosure will be described clearly and completely hereinafter in conjunction with the drawings in the embodiments of the present disclosure. Apparently, the described embodiments are only a part of the embodiments of the present disclosure, rather than all embodiments. Based on the embodiments in the present disclosure, all of other embodiments, made by the person skilled in the art without any creative efforts, fall into the scope of protection of the present disclosure.

Figure 5:
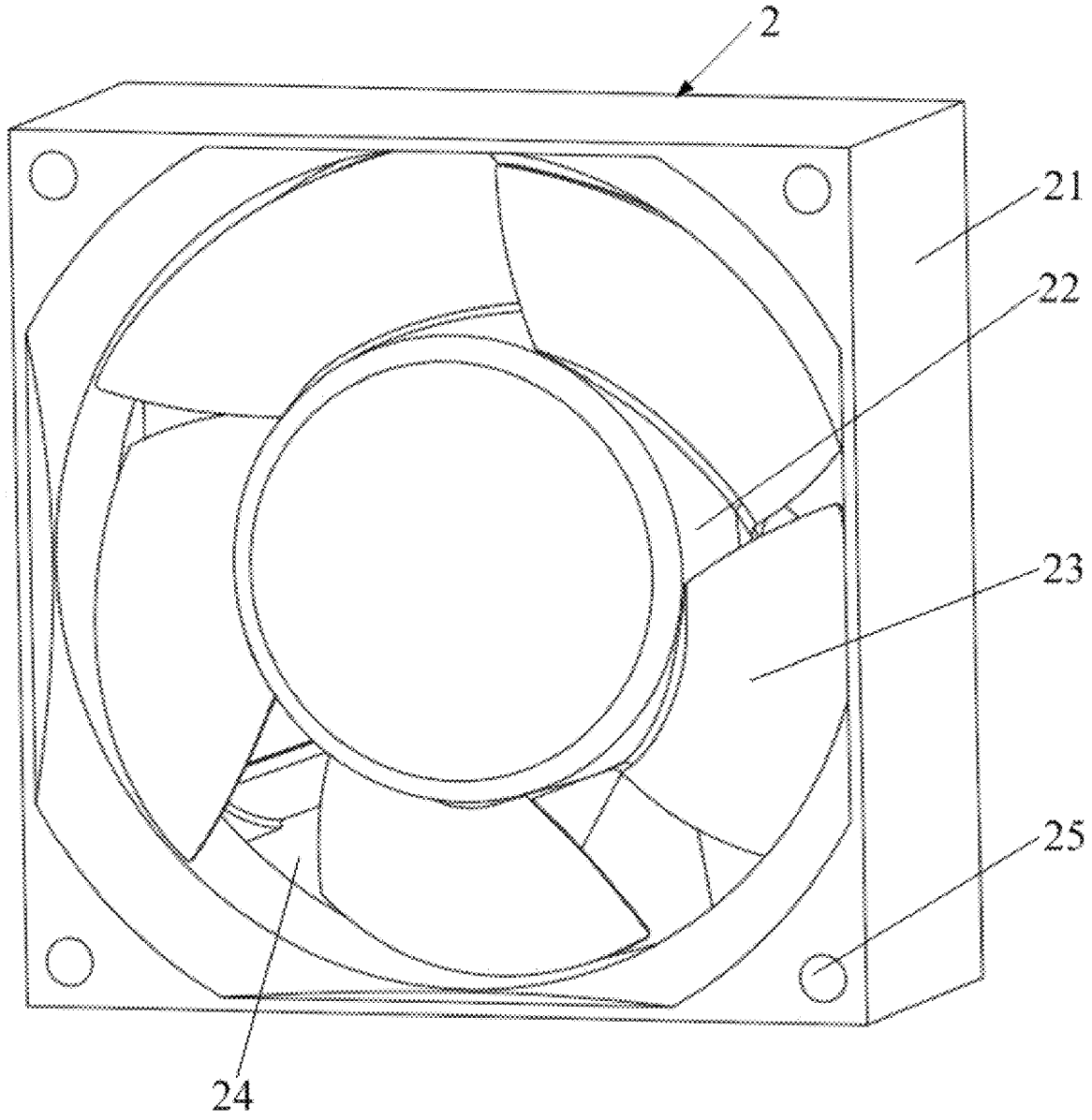
FIG. 5 is a schematic structural view of the fan in FIG. 4.
Figure 6:
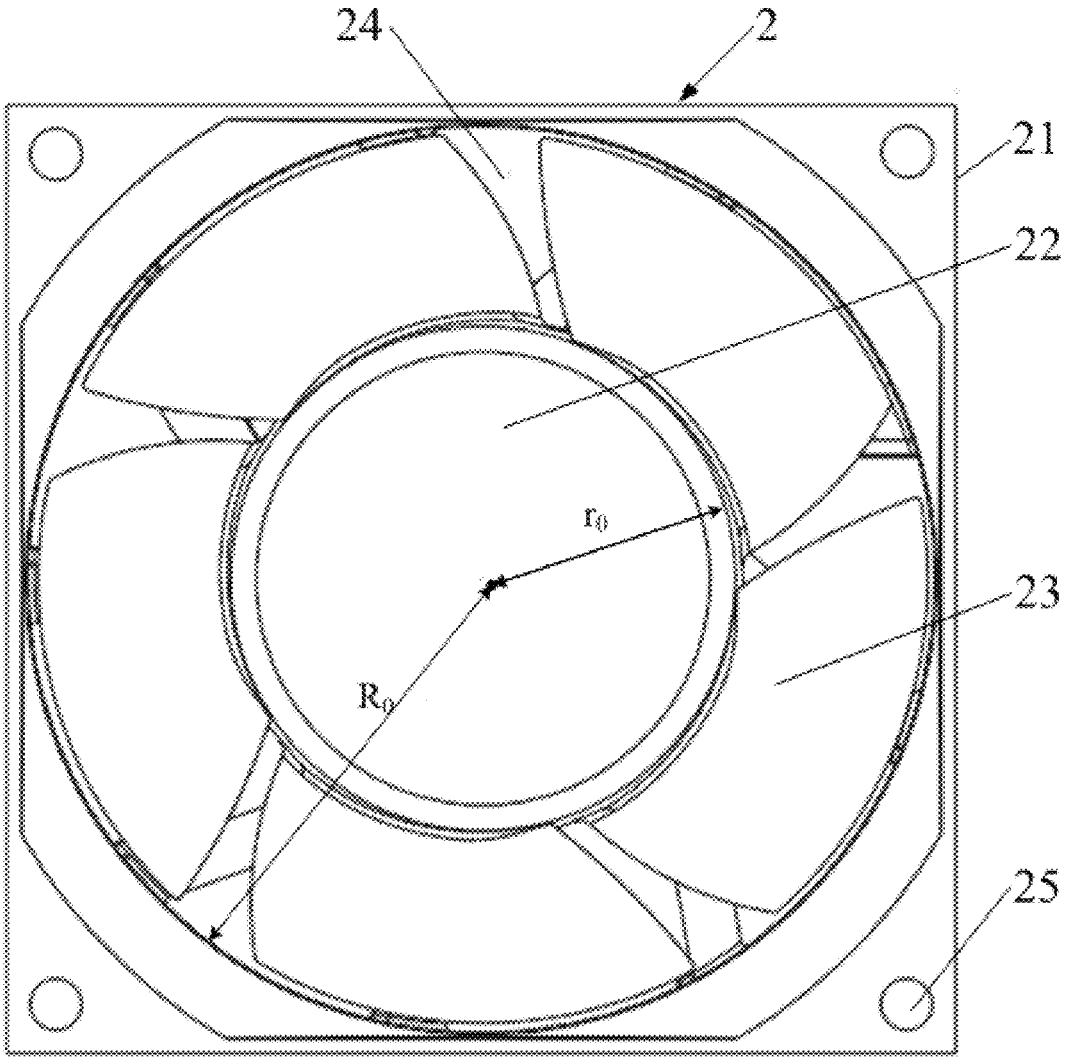
FIG. 6 is a front view of the structure shown in FIG. 5.

The fairing according to the embodiments of the present disclosure is applied in a fan 2. As shown in FIG. 5 and FIG. 6, the fan 2 includes a fan housing 21, a fan rotation shaft 22 and fan blades 23, the fan housing 21 has a fan duct 24, the fan rotation shaft 22 and the fan blades 23 are located in the fan duct 24, the fan blades 23 are fixed to the fan rotation shaft 22, and the fan rotation shaft 22 can be rotated to drive the fan blades 23 to rotate.

As shown in FIG. 1, FIG. 2, FIG. 4, FIG. 8 and FIG. 10, the fairing according to the embodiment of the present disclosure includes a fairing body 11 arranged at a fan air vent, the fairing body 11 has a fairing area 12, and the fairing area 12 is provided with a fairing through hole 13.

It can be understood that the fairing body 11 has a non-fairing area at an inner side of an inner ring of the fairing area 12. The fairing body 11 has a non-fairing area at an outer side of an outer ring of the fairing area 12, or the outer ring of the fairing area 12 is an outer side of the fairing body 11.

In the fairing provided in the above embodiment, the fairing body 11 has the fairing area 12, the fairing area 12 is provided with the fairing through hole 13, and the fairing body 11 is configured to be arranged at the fan air vent, so that the airflow is faired through the fairing through hole 13, which reduces the turbulence at the fan air vent, thereby reducing the noise of the fan 2.

Figure 12:
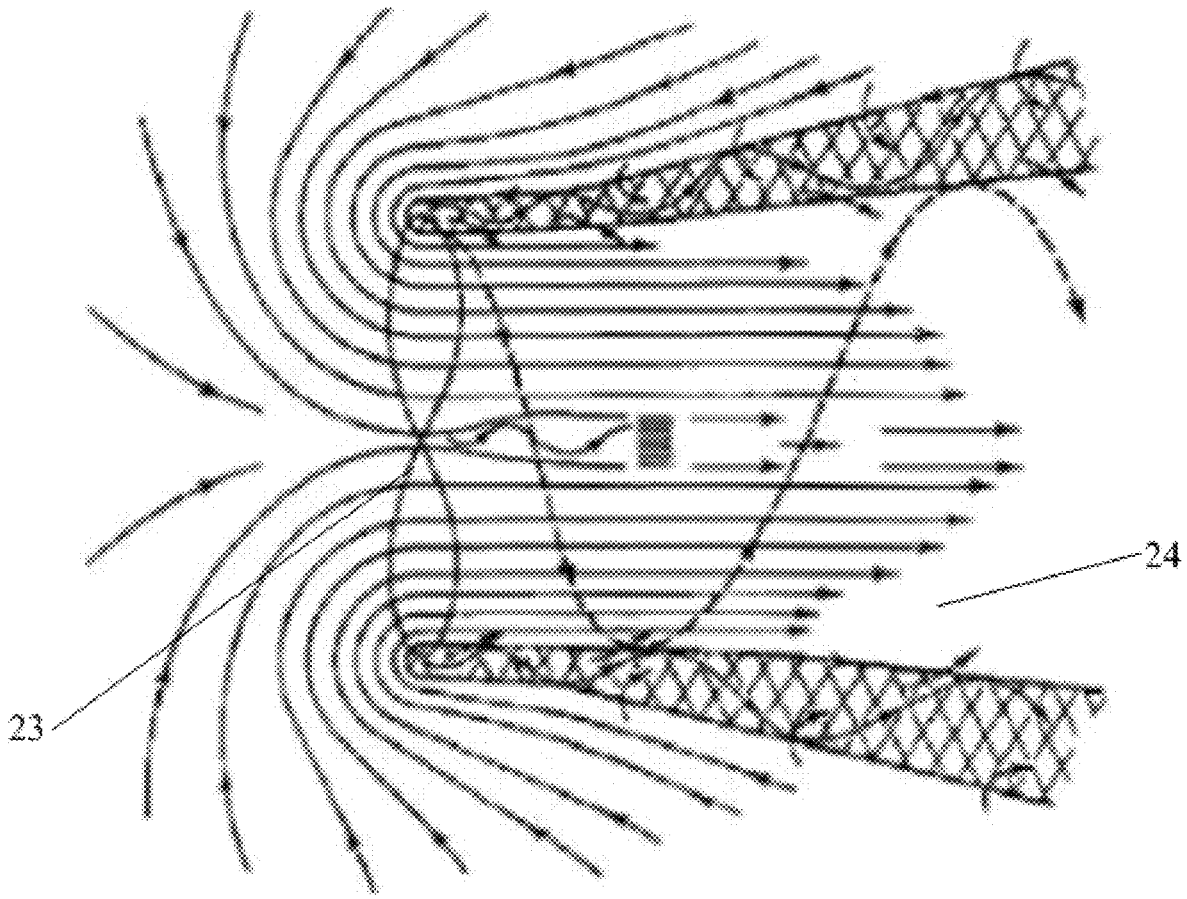
FIG. 12 is a flow field trajectory diagram of an existing fan.

As shown in FIG. 12, it can be seen that the turbulent at the air inlet of the fan 2 is large, and the existence of turbulent is one of the most important factors of the noise of the fan. FIG. 12 is obtained by the simulation software FLUENT. FIG. 12 is a flow field trajectory diagram of air flowing into the air inlet of the fan 2 from the outer side and then exiting the air outlet of the fan 2 in case that the fan 2 is in operation. It can be seen from FIG. 12 that the turbulence at the air inlet is large, that is, the variation of the wind velocity direction is great when the air is flowed in, and the most variation of the wind velocity direction appears at the edge of the fan blade 23, and the least variation of the wind velocity direction appears at the center of the fan blade 23. Assuming that a rotational angular velocity of the fan 2 is $\Omega$, a linear velocity of a certain point on the fan blade 23 is $V=\Omega S$, where S is a distance from the point on the fan blade 23 to the rotation center of the fan 2. It can be seen from the linear velocity formula that the farther away from the rotation center of the fan 2 is, the greater the linear velocity of the fan blade 23 is, and it can be known from the energy theorem that the stronger the turbulence capacity of this position is. Therefore, it can be concluded that the position where the air is disturbed most is located is at a tip of the fan blade 23, that is, at the edge, farthest from the rotation center of the fan 2, of the fan duct 24. By contrast, since the position where the fan shaft 22 is located has no fan blade 23, the air is disturbed least at this position, that is, the closer it is to the rotation center, the less the air velocity is, and the less the turbulence is. Therefore, it is not required for fairing at the rotation center of the fan 2. It can be understood that the rotation center of the fan 2 is an axis of the fan rotation shaft 22.

Based on the above idea, the fairing area 12 is annular and is located at a periphery of a geometric center of the fairing body 11. It can be understood that, in FIG. 1, FIG. 8 and FIG. 10, the point O is the geometric center of the fairing body 11. The geometric center of the fairing body 11 is collinear with the axis of the fan rotation shaft 22.

In the fairing provided in the above embodiments, the fairing area 12 is annular and is located at the periphery of the geometric center of the fairing body 11, so that the fairing body 11 has no fairing through hole 13 at its geometric center, which not only ensures the noise reduction effect, but also facilitates of the processing and reduces the cost.

After tests being made, the noise of the fan can be reduced by about 4 dBA after the fairing of the above embodiments is applied to each fan 2.

In a specific embodiment, since fairing is not required at the rotation center of the fan 2, optionally, the fairing body 11 can be configured to have a non-fairing area at an inner side of an inner ring of the fairing area 12, a projection of the non-fairing area on a projection plane completely falls on an end face of the fan rotation shaft 22, and the projection plane is coplanar with the end face of the fan rotation shaft 22.

It can be understood that the end surface of the fan rotation shaft 22 only refers to one of end faces of the fan rotation shaft 22. The end surface can be an end surface, close to the fairing body 11, of the fan rotation shaft 22, or an end surface, away from the fairing body 11, of the fan rotation shaft 22. The projection of the non-fairing area on the projection plane is not extended beyond the end surface of the fan rotation shaft 22.

In the above embodiments, taking the inner ring of the fairing area 12 being in a circle shape as example, $0<r\leq r_0$; where r is a radius of the inner ring of the fairing area 12, and $r_0$ is a radius of the fan rotation shaft 22, which ensures that the projection of the non-fairing area on the projection plane completely falls on the end face of the fan rotation shaft 22.

In practical disclosure, if the inner ring of the fairing area 12 has other shapes, it can be designed according to the above requirements, which is not limited in this embodiment.

In another specific embodiment, in order to improve the fairing effect, it is necessary to ensure that the airflow is flowed into the fan duct 24 through the fairing area 12. Specifically, the projection of the fairing area 12 on the projection plane and a projection of the fan duct 24 on the projection plane have an overlapping portion. The projection plane is perpendicular to an axis of the fan duct 24.

In the above embodiments, taking the outer ring of the fairing area 12 being in a circle shape as example, $R \geq R_0$; R is a radius of the outer ring of the fairing area 12, and $R_0$ is an inner diameter of the fan duct 24. Taking the outer ring of the fairing area 12 being in a polygon shape as example, $L \geq R_0$; L is a minimum distance between a side of the polygon and a geometric center of the polygon, and $R_0$ is an inner diameter of the fan duct 24.

It should be noted that the above polygon can be triangle, quadrangle, pentagon, or hexagon, etc., and the above polygon can be regular polygon, which is not limited in this embodiment.

In another specific embodiment, in order to avoid redundant fairing parts in the fairing area 12, the outer ring of the fairing area 12 does not extend beyond the fan housing 21 of the fan 2, which reduces the cost, and ensures the aesthetics of the whole structure.

In the above fairing, the fairing body 11 has a non-fairing area at the inner side of the inner ring of the fairing area 12. In a specific embodiment, in order to save material and reduce weight and cost, the non-fairing area is provided with a material saving structure. In this case, the non-fairing area can have a solid structure or a hollow structure, which can be selected according to actual needs.

The material saving structure may be a material saving groove, a material saving through hole or a hollow structure. As shown in FIG. 1, FIG. 2, FIG. 4, FIG. 8 and FIG. 10, in order to facilitate processing, the material saving structure is a material saving through hole 14. Specifically, a hole wall of the material saving through hole 14 coincides with the inner ring of the fairing area 12, which can save material, weight and cost to the greatest extent. Certainly, a preset distance between the hole wall of the material saving through hole 14 and the inner ring of the fairing area 12 may be provided, which is not limited in this embodiment.

It can be understood that the material saving through hole 14 is larger than the fairing through hole 13, so as to ensure no fairing effect in the non-fairing area. The material saving through hole 14 can be one or two or more, which is not limited in this embodiment.

In the above embodiment, if the material saving structure is the material saving through hole 14, the wind resistance of the fairing is further reduced, the rotation speed of the fan 2 is increased, and the heat dissipation effect of the fan 2 is improved.

In another specific embodiment, an inner side surface of the non-fairing area is flush with an inner side surface of the fairing body 11, and an outer side surface of the non-fairing area is flush with an outer side surface of the fairing body 11. In this way, it is not necessary to process the non-fairing area of the fairing body 11, and only the fairing area 12 of the fairing body 11 is processed, which facilitates of processing and reduces the cost to the greatest extent.

It can be understood that the inner side surface of the non-fairing area refers to a side surface, close to the fan 2, of the non-fairing area, the outer side surface of the non-fairing area refers to a side surface, away from the fan 2, of the non-fairing area, and the inner side surface of the fairing body 11 refers to a side surface, close to the fan 2, of the fairing body 11, and the outer side surface of the fairing body 11 refers to a side surface, away from the fan 2, of the fairing body 11.

In the fairing, the specific shape of the fairing area 12 is selected according to actual needs. In an embodiment, the inner ring of the fairing area is in a shape of circle, ellipse or polygon. In order to facilitate processing, as shown in FIG. 1, FIG. 2, FIG. 4, FIG. 8 and FIG. 10, the inner ring of the fairing area 12 can be configured to be in a circle shape. Since the fan rotation shaft 22 is a circular shaft, it facilitates of improving the fairing effect. It can be understood that a quadrate is a rectangle or a square.

Figure 8:
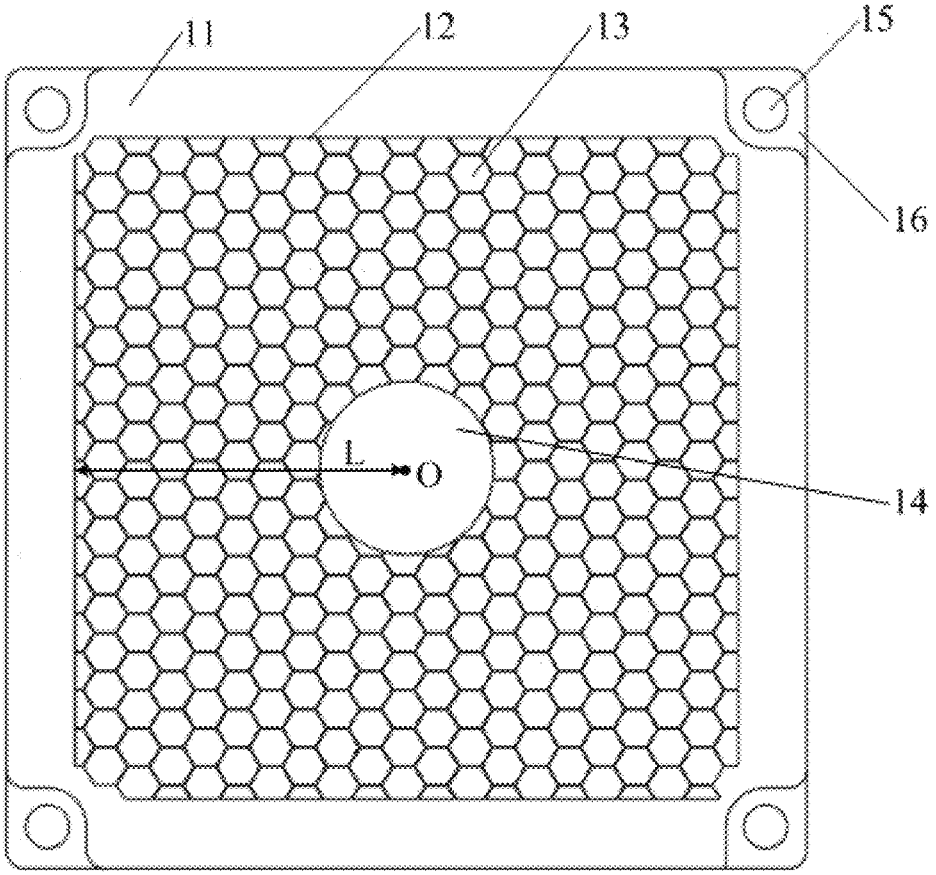
FIG. 8 is another schematic structural view of the fairing according to another embodiment of the present disclosure.

In another aspect, the outer ring of the fairing area 12 is in shape of circle, ellipse or polygon. In order to facilitate of processing, the outer ring of the fairing area 12 can be configured to be circle or polygon. Specifically, as shown in FIG. 1, FIG. 2, FIG. 4 and FIG. 10, the outer ring of the fairing area 12 is circle; as shown in FIG. 8, the outer ring of the fairing area 12 is quadrate.

In the fairing, at least one fairing through hole 13 is provided. In order to improve the fairing effect, two or more fairing through holes 13 can be provided, and the fairing through holes 13 are evenly distributed in the fairing area 12.

In the above fairing, the size of the fairing through holes 13 can be configured according to actual needs, as long as fairing effect is ensured. The shape of the fairing through holes 13 can also be configured according to actual needs, for example, the fairing through holes 13 are circles, ellipses or polygons. The polygon can be triangle, quadrangle, pentagon, or hexagon. The above polygon can also be regular polygon. In order to facilitate of processing, the fairing through holes 13 can be configured to be in shape of circle or regular polygon.

In a specific embodiment, in order to ensure the strength of the fairing, there is a preset distance between the two adjacent fairing through holes 13, that is, a preset distance between walls of the two adjacent fairing through holes 13. The specific value of the preset distance is selected according to actual needs, which is not limited in this embodiment.

Figure 1:
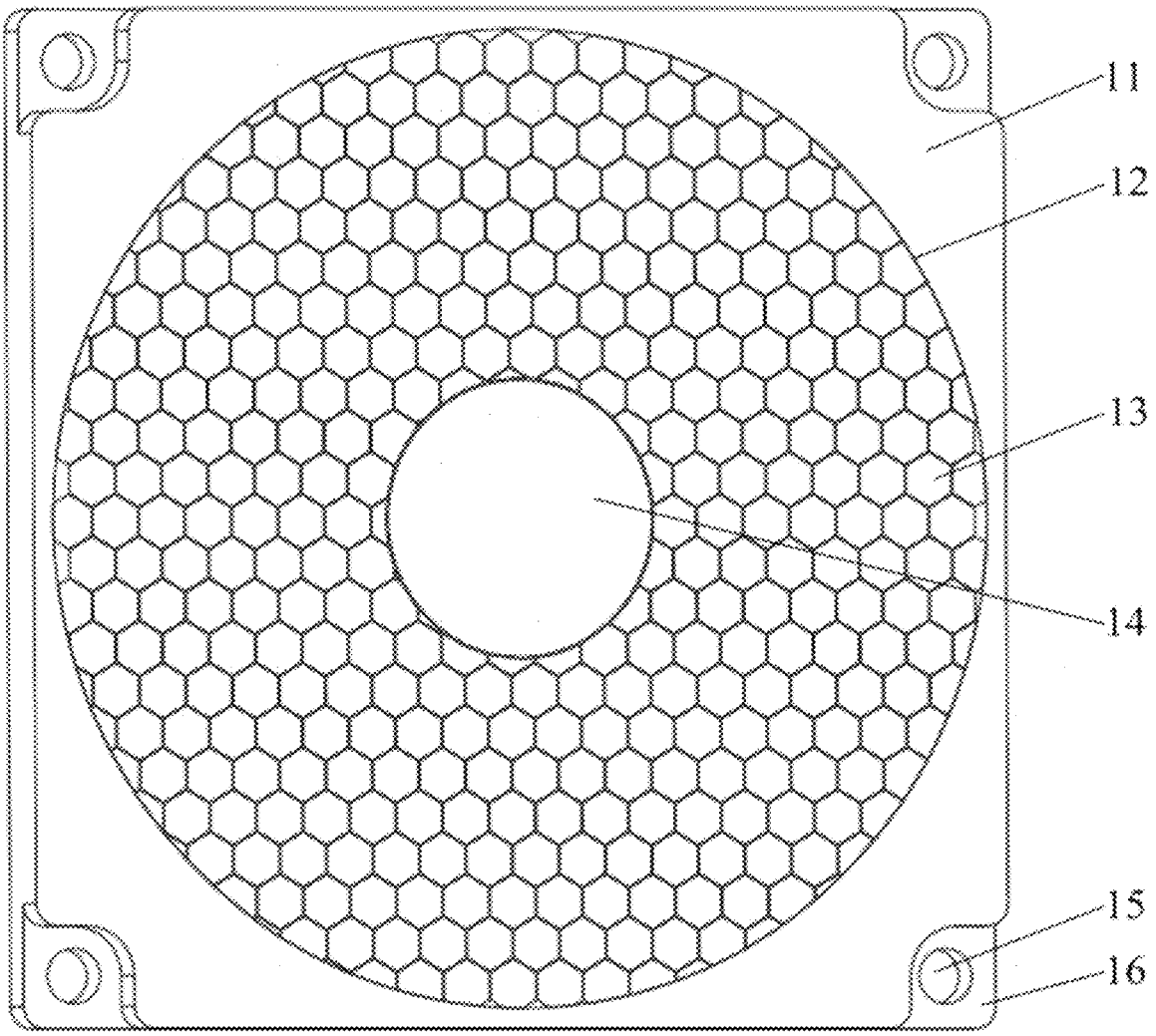
FIG. 1 is a schematic structural view of a fairing according to an embodiment of the present disclosure.
Figure 2:
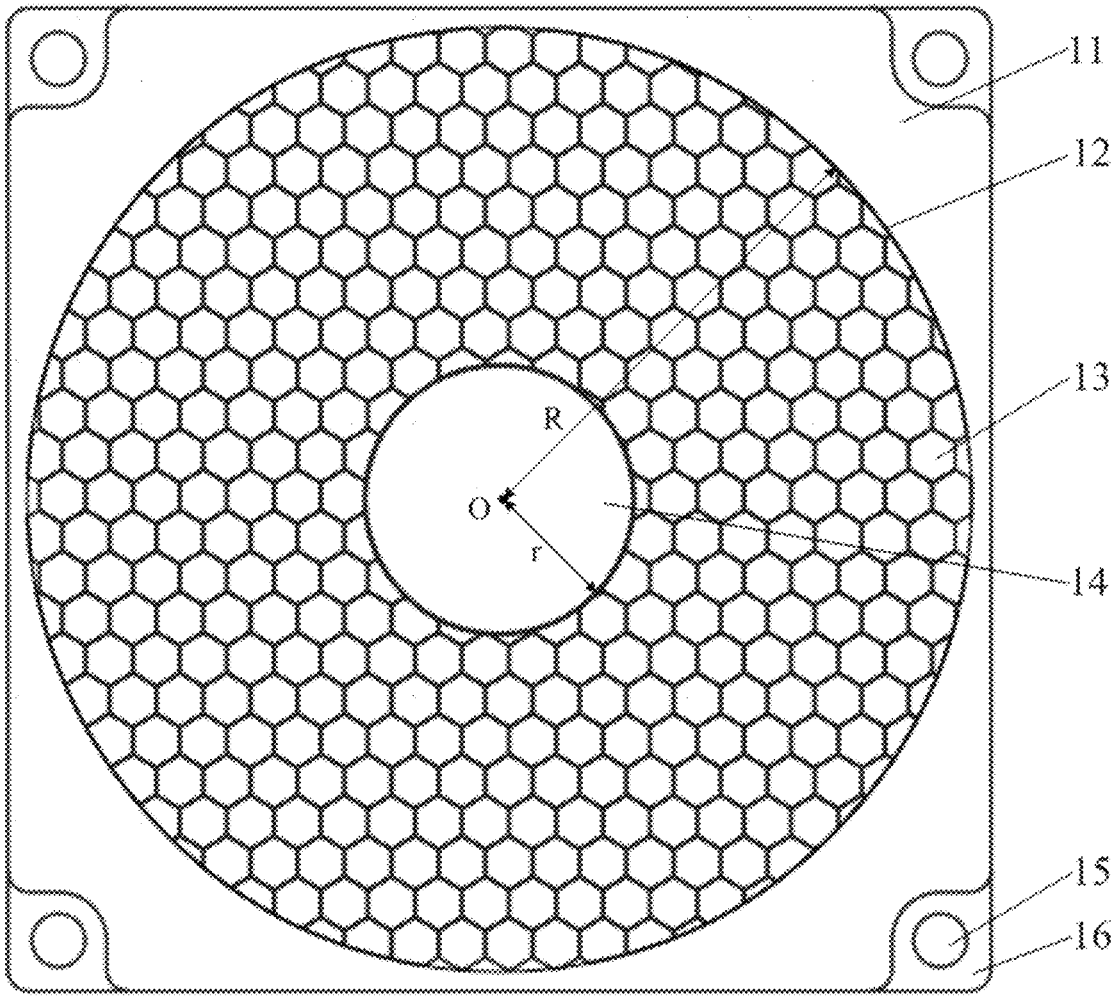
FIG. 2 is a front view of the fairing shown in FIG. 1.
Figure 3:
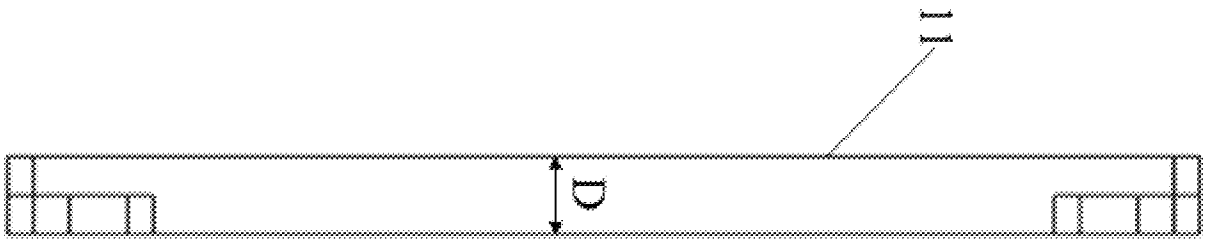
FIG. 3 is a side view of the fairing shown in FIG. 1.
Figure 9:
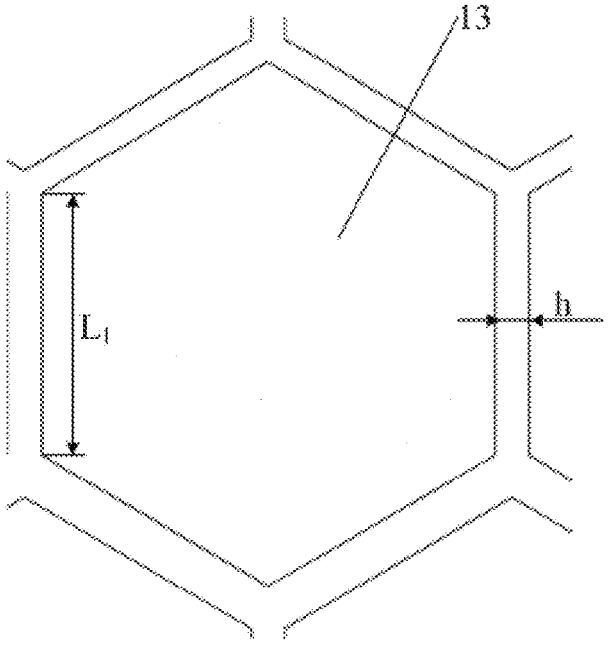
FIG. 9 is a schematic enlarged view of a fairing through hole in FIG. 1 and FIG. 8.
Figure 10:
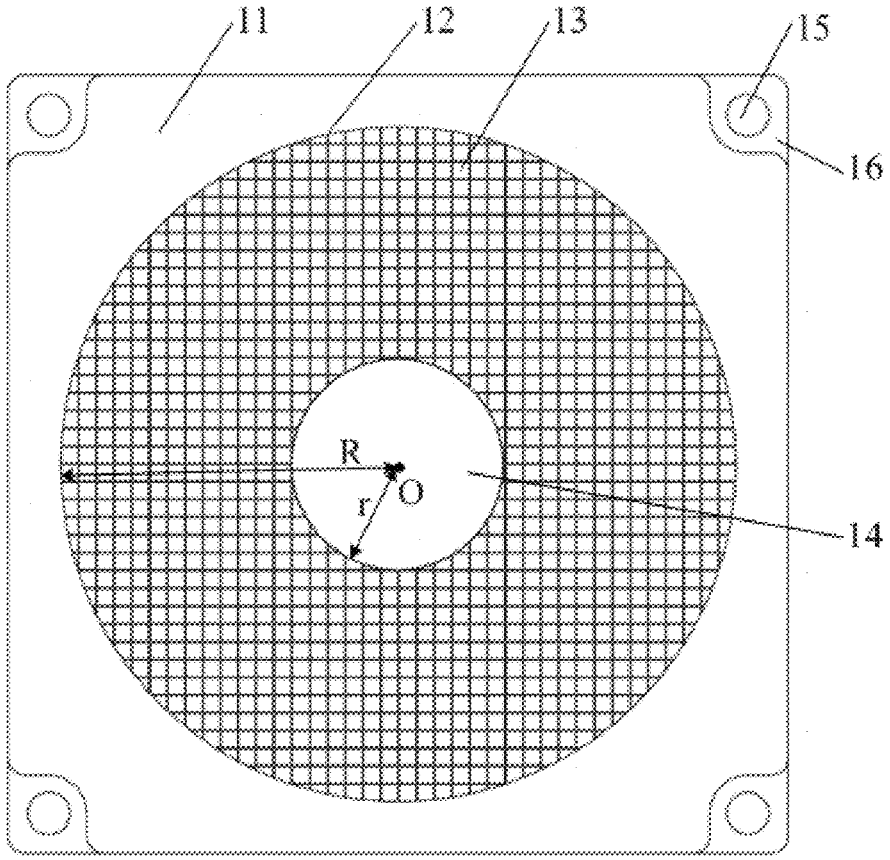
FIG. 10 is another schematic structural view of the fairing according to another embodiment of the present disclosure.
Figure 11:
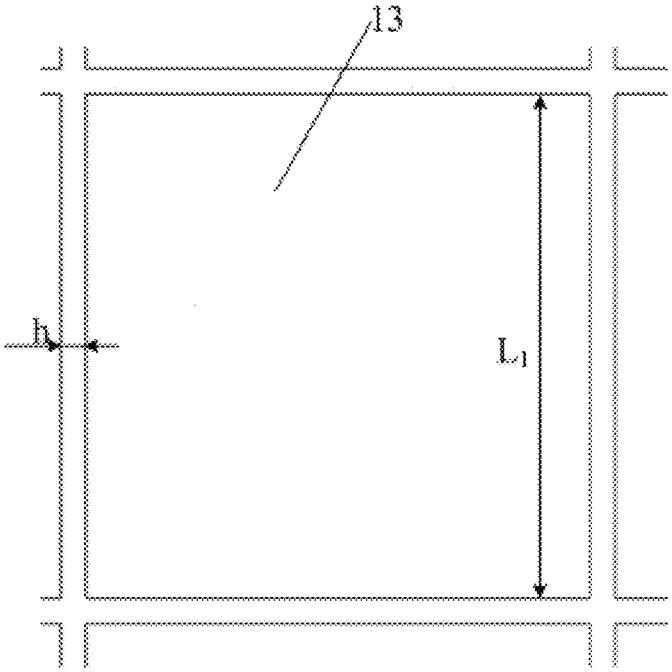
FIG. 11 is a schematic enlarged view of the fairing through hole in FIG. 10.

Specifically, taking the fairing through holes 13 being in shape circle as an example, it can be configured that $1\ mm \leq R_1 \leq 20\ mm$, $0.01\ mm \leq h \leq 0.5\ mm$ and $2\ mm \leq D \leq 50\ mm$; taking the fairing through holes 13 being in shape regular polygon as an example, it can be configured that $1\ mm \leq L_1 \leq 20\ mm$, $0.01\ mm \leq h \leq 0.5\ mm$ and $2\ mm \leq D \leq 50\ mm$; where R1 is a radius of the fairing through holes 13; as shown in FIG. 9 and FIG. 11, L1 is a side length of the regular polygon; as shown in FIG. 3, D is a thickness of the fairing area 12; as shown in FIG. 9 and FIG. 11, h is a minimum distance between two adjacent fairing through holes 13.

In order to facilitate of processing, a thickness of the fairing body 11 is the same as the thickness of the fairing area 12.

In the above fairing, the shape of the fairing body 11 is configured according to actual needs, such as according to the shape of the fan housing 21. Specifically, the fairing body 11 is in shape of circle or polygon. Since the fan housing 21 is generally a quadrate, the fairing body 11 can be configured to be in quadrate.

In a specific embodiment, in order to improve the aesthetics, an edge of the fairing body 11 can be configured to be flush with an edge of the fan housing 21. Certainly, the edge of the fairing body 11 and the edge of the fan housing 21 can also be configured to be in other relative positional relation, which is not limited to the above definition.

In a specific embodiment, in order to facilitate the mounting of the fairing, the edge of the fairing body 11 is provided with mounting holes 15 for being arranged on the fan 2. Specifically, the mounting holes 15 are used for mounting on the fan housing 21 of the fan 2, and the fairing body 11 is fixed to the fan housing 21 by fasteners passing through the mounting holes 15. In that case, the fan 2 can be provided with fixing holes 25.

In the above embodiments, in order to prevent the fastener from protruding from the outer side surface of the fairing body 11, the fairing body 11 is provided with recesses 16, and the mounting holes 15 are respectively located in the recesses 16.

It can be understood that the outer side surface of the fairing body 11 refers to a side surface, away from the fan 2, of the fairing body 11.

In practical disclosure, if the fairing 11 is in polygon, in order to facilitate of mounting, the above mounting holes 15 and the recesses 16 can be both configured to be located at corners of the fairing body 11. For example, the fairing body 11 is in quadrate, and the mounting holes 15 and the recesses 16 are distributed at four corners of the fairing body 11. If the fairing body 11 is in shape of circle, in order to facilitate of mounting, the mounting holes 15 and the recesses 16 can be both configured to be located at the edge of the fairing body 11.

It can be understood that the above quadrate can be a square or a rectangle.

In the fairing provided in the above embodiments, the fairing body 11 is configured to be arranged at the fan air vent, which is an air inlet and/or an air outlet. Therefore, the fairing body 11 can be configured to be located at the air inlet of the fan 2, or the fairing body 11 can be located at the air outlet of the fan 2, or the fairing bodies 11 can be located at the air inlet and the air outlet of the fan 2, which is selected according to actual needs, and is not limited in this embodiment.

Figure 4:
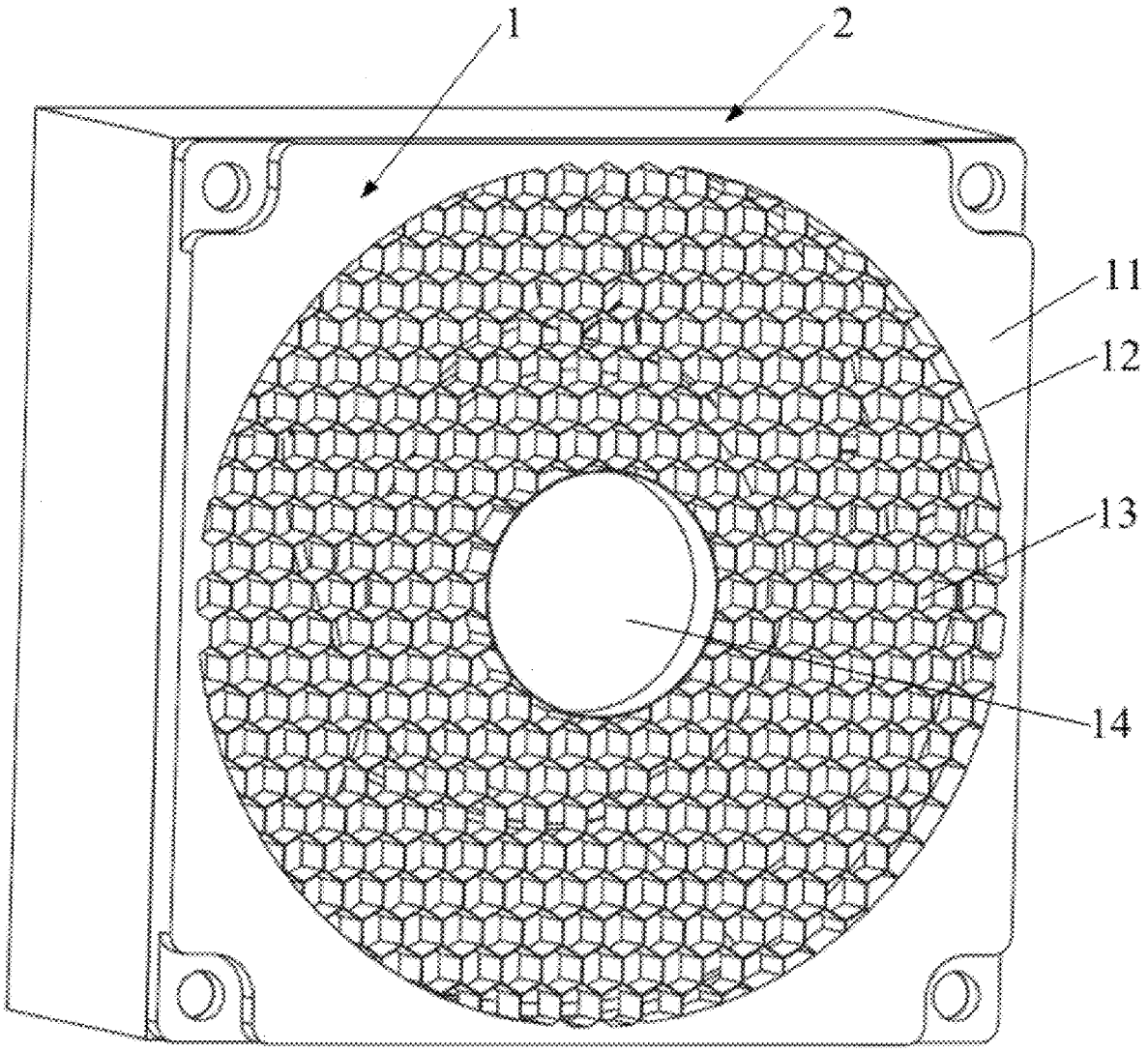
FIG. 4 is a structural schematic view of the fairing shown in FIG. 1 mounted at an air inlet of a fan.
Figure 7:
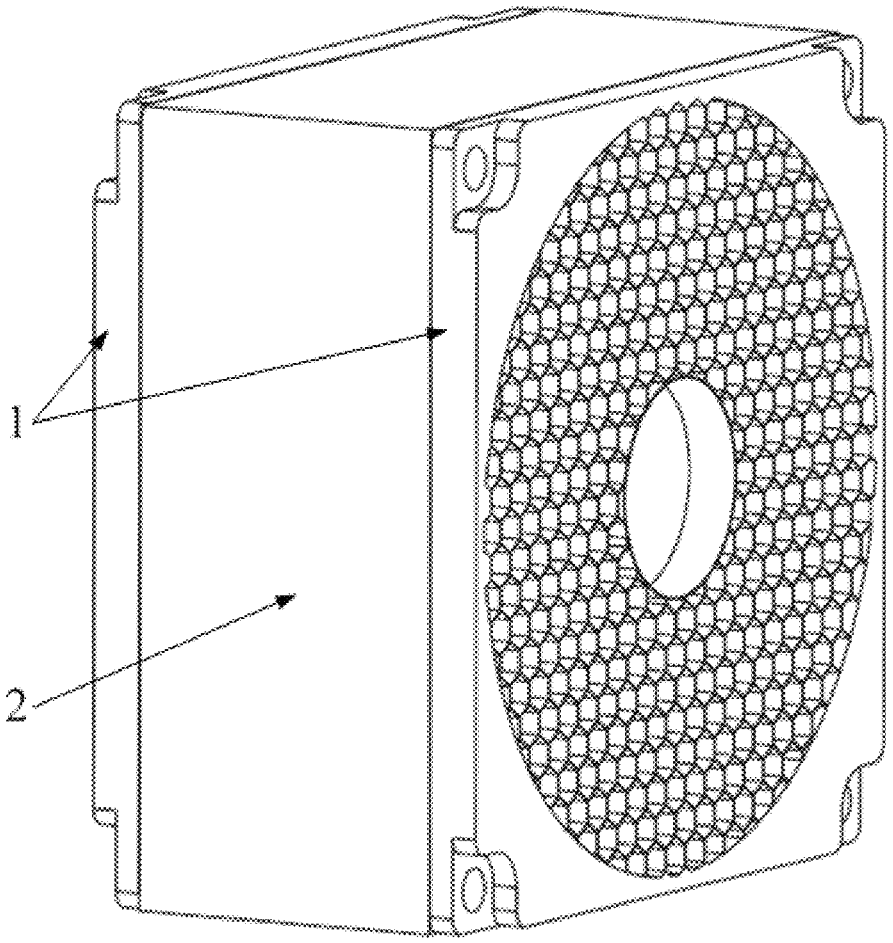
FIG. 7 is a structural schematic view of the fairings shown in FIG. 1 mounted at the air inlet and an air outlet of the fan.

Specifically, as shown in FIG. 4, the fairing body 11 is located at the air inlet of the fan 2; as shown in FIG. 7, two fairing bodies 11 are provided, one fairing body 11 is located at the air inlet of the fan 2, and the other fairing body 11 is located at the air outlet of the fan 2.

Based on the fairing provided by the above embodiments, a fan device is further provided according to this embodiment. As shown in FIG. 4 and FIG. 7, the fan device includes: a fan 2, and the fairing 1 as described in the above embodiments. It can be understood that, the fairing body 11 of the fairing 1 is arranged at the fan air vent of the fan 2, that is, the whole fairing 1 is arranged at the fan air vent of the fan 2.

Since the fairing provided by the above embodiments has the above technical effect, and the fan device includes the fairing provided by the above embodiments, the fan device also has the corresponding technical effect, which is not described here.

In the above fan device, in order to improve the fairing effect, the fairing bodies 11 can be configured to be located at the air inlet and the air outlet of the fan 2. In order to simplify the structure, the fairing body 11 can be configured to be located at the air inlet or the air outlet of the fan 2.

If the fairing bodies 11 are located both at the air inlet and the air outlet of the fan 2, it can be understood that, in this case, two fairing bodies 11 are provided, that is, two fairings 1 are provided. Specifically, the fairing body 11 arranged at the air inlet is the same as or different from the fairing body 11 arranged at the air outlet.

Specifically, if the fairing body 11 arranged at the air inlet is different from the fairing body 11 arranged at the air outlet, the shapes of the fairing through holes 13 of the two fairing bodies 11, the sizes of the fairing through holes 13 of the two fairing bodies 11, the numbers of the fairing through holes 13 of the two fairing bodies 11, the shapes of the fairing areas 12 of the two fairing bodies 11 and the sizes of the fairing areas 12 of the two fairing bodies 11 can be configured to be different, and other differences can be configured according to the actual needs, which are not limited in this embodiment.

Specifically, if the fairing body 11 arranged at the air inlet is the same as the fairing body 11 arranged at the air outlet, the two fairing bodies 11 are completely identical.

In the fan device, in order to facilitate of mounting, the fairing body 11 can be configured to be fixed to the fan housing 21 of the fan 2. In order to facilitate disassembly and assembly, the fairing body 11 is detachably fixed to the fan housing 21 of the fan 2.

Specifically, the fairing body 11 is fixed to the fan housing 21 of the fan 2 by a threaded connecting member. It can be understood that in this case, the fairing body 11 is provided with mounting holes 15, the fan housing 21 is provided with fixing holes 25, and the fixing holes 25 are one-to-one correspondence with the mounting holes 15.

In the above fan device, the material of the fairing 1 is configured according to actual needs. For example, the fairing 1 is made of metal or non-metal, which is not limited in this embodiment.

Specifically, if the fairing 1 is made of metal, the fairing 1 can be configured as an aluminum alloy member, which is easy to process and has low cost.

Specifically, if the fairing 1 is made of non-metal, the fairing 1 can be configured as a plastic member, which is easy to process and has low cost. Further, the fairing 1 is a PBT (polybutylece terephthalate) plastic member.

In the fan device, the structure of the fan 2 can make reference to the foregoing description, which is not described here. The type of the fan 2 can be selected according to actual needs. In order to improve the fairing effect, the fan 2 can be selected as an axial-flow fan. Of course, other types of the above cleaning device may also be selected, which is not limited in this embodiment.

The above illustration of the disclosed embodiments can enable those skilled in the art to implement or use the present disclosure. Various modifications to the embodiments are apparent to the person skilled in the art, and the general principle herein can be implemented in other embodiments without departing from the spirit or scope of the present disclosure. Therefore, the present disclosure is not limited to the embodiments described herein, but should be in accordance with the broadest scope consistent with the principle and novel features disclosed herein.

The invention claimed is:

1. A fairing, comprising a fairing body which is arranged at an air vent of a fan, wherein an axis of the fairing body is collinear with an axis of the fan rotation shaft of the fan, wherein the fairing body has a fairing area, the fairing area is annular and is located at a periphery of a geometric center of the fairing body perpendicular to the axis of the fan rotation shaft, and the fairing area is provided with a plurality of fairing through holes, wherein the fairing body is provided with a non-fairing area at an inner side of an inner ring of the fairing area perpendicular to the axis of the fan rotation shaft, and the non-fairing area is provided with a material saving structure, wherein the material saving structure is a material saving through hole, an area of the material saving through hole is larger than each of the plurality of fairing through holes and a hole wall of the material saving through hole coincides with the inner ring of the fairing area, wherein, along the axis of the fan rotation shaft, an inner side surface, close to the fan, of the non-fairing area is flush with an inner side surface of the fairing body, and an outer side surface, away from the fan, of the non-fairing area is flush with an outer side surface of the fairing body, wherein, if an outer ring of the fairing area is in shape of circle, $R \geq R_0$;

if the outer ring of the fairing area is in shape of polygon, $L \geq R_0$;

wherein R is a radius of the outer ring of the fairing area, $R_0$ is an inner diameter of a fan duct, and L is a minimum distance between a side of the polygon and a geometric center of the polygon.

2. The fairing according to claim 1, wherein an inner ring of the fairing area is a circle, and an outer ring of the fairing area is in shape of circle or polygon.

3. The fairing according to claim 1, wherein the fairing body is provided with a non-fairing area at an inner side of an inner ring of the fairing area, a projection of the non-fairing area on a projection plane completely falls on an end surface of a fan rotation shaft, and the projection plane is coplanar with the end surface of the fan rotation shaft.

4. The fairing according to claim 3, wherein the inner ring of the fairing area is in shape of circle, and $0 < r \leq r_0$; wherein r is a radius of the inner ring of the fairing area, and $r_0$ is a radius of the fan rotation shaft.

5. The fairing according to 1, wherein, a projection of the fairing area on a projection plane and a projection of a fan duct on the projection plane have an overlapping portion, and the projection plane is perpendicular to an axis of the fan duct;

and, an outer ring of the fairing area is not extended beyond a fan housing of a fan.

6. The fairing according to claim 1, wherein each of the plurality of fairing through holes is in shape of circle or regular polygon.

7. The fairing according to 1, wherein, if the plurality of fairing through holes are in shape of circle, $1\ mm \leq R_1 \leq 20\ mm$, $0.01\ mm \leq h \leq 0.5\ mm$, and $2\ mm \leq D \leq 50\ mm$;

or if the plurality of fairing through holes are in regular polygon, $1\ mm \leq L_1 \leq 20\ mm$, $0.01\ mm \leq h \leq 0.5\ mm$, and $2\ mm \leq D \leq 50\ mm$;

wherein $R_1$ is a radius of each of the plurality of fairing through holes, $L_1$ is a side length of the regular polygon, h is a minimum distance between two adjacent fairing through holes, and D is a thickness of the fairing area.

8. The fairing according to 1, wherein, mounting holes, which are configured to mount the fairing body on the fan, are provided at an edge of the fairing body;

and the fairing body is in shape of quadrate;

and edge of the fairing body is flush with an edge of a fan housing.

9. The fairing according to claim 1, wherein the air vent of the fan is an air inlet of the fan or an air outlet of the fan.

10. A fan device, comprising a fan, and the fairing according to claim 1.

11. The fan device according to claim 10, wherein two air vents of the fan are provided, which are an air inlet of the fan and an air outlet of the fan, and the fairing body arranged at the air inlet of the fan is the same as or different from the fairing body arranged at the air outlet of the fan.

12. The fan device according to claim 10, wherein the fairing body is detachably fixed to a fan housing of the fan;

and, the fan is an axial-flow fan.

* * * * *